US007683731B2

(12) United States Patent
Kroening

(10) Patent No.: US 7,683,731 B2
(45) Date of Patent: Mar. 23, 2010

(54) FERRITE WAVEGUIDE CIRCULATOR WITH THERMALLY-CONDUCTIVE DIELECTRIC ATTACHMENTS

(75) Inventor: Adam M. Kroening, Atlanta, GA (US)

(73) Assignee: EMS Technologies, Inc., Norcross, GA (US)

( * ) Notice: Subject to any disclaimer, the term of this patent is extended or adjusted under 35 U.S.C. 154(b) by 171 days.

(21) Appl. No.: 11/580,195

(22) Filed: Oct. 13, 2006

(65) Prior Publication Data

US 2007/0139131 A1 Jun. 21, 2007

Related U.S. Application Data

(60) Provisional application No. 60/752,339, filed on Dec. 20, 2005.

(51) Int. Cl.
*H01P 1/39* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS

| | | | | |
|---|---|---|---|---|
| 3,221,255 | A | 11/1965 | Rabowsky et al. | |
| 3,246,262 | A | 4/1966 | Wichert | |
| 3,277,339 | A | 10/1966 | Carney | |
| 3,339,158 | A | 8/1967 | Passaro | |
| 3,341,789 | A | 9/1967 | Goodman et al. | |
| 3,350,663 | A | 10/1967 | Siekanowicz et al. | |
| 3,530,387 | A | 9/1970 | Bonfeld et al. | |
| 3,582,831 | A | 6/1971 | Siekanowicz et al. | |
| 3,710,280 | A | 1/1973 | Buck | |
| 3,806,837 | A | 4/1974 | Carr et al. | |
| 4,058,780 | A | 11/1977 | Riblet | |
| 4,697,158 | A | 9/1987 | Hoover et al. | |
| 4,810,979 | A * | 3/1989 | Morz et al. | 333/1.1 |
| 5,266,909 | A | 11/1993 | Wolfert | |
| 5,608,361 | A | 3/1997 | Weiss et al. | |
| 5,724,010 | A | 3/1998 | Brown | |
| 6,885,257 | B2 | 4/2005 | Kroening | |
| 7,049,900 | B2 | 5/2006 | Kroening | |
| 7,176,767 | B2 | 2/2007 | Ramarajan | |
| 7,230,507 | B2 | 6/2007 | Kroening | |
| 7,242,263 | B2 | 7/2007 | Kroening | |
| 7,280,004 | B2 | 10/2007 | Kroening | |
| 2003/0107447 | A1 * | 6/2003 | Kroening | 333/1.1 |
| 2005/0179504 | A1 | 8/2005 | Kroening | |
| 2007/0139131 | A1 | 6/2007 | Kroening | |
| 2009/0108953 | A1 | 4/2009 | Kroening | |

FOREIGN PATENT DOCUMENTS

| | | |
|---|---|---|
| DE | 34 41 352 | 5/1986 |

(Continued)

OTHER PUBLICATIONS

Zaal: "Some Experimental Results on the X-Band Junction Circulator," Transactions on Mirowave Theory and Techniques, vol. 13, No. 3 (May 1, 1965), pp. 382-383, XP0024889112.

(Continued)

*Primary Examiner*—Stephen E Jones
(74) *Attorney, Agent, or Firm*—Hogan & Hartson LLP

(57) ABSTRACT

The present invention improves the geometry of ferrite circulators in order to increase the average power handling by decreasing the temperature rise in the ferrite and associated adhesive bonds. Embodiments of the present invention utilize dielectric attachments on the sides of the ferrite element, which maximizes the area of contact and minimizes the path length from the ferrite element out to the thermally conductive attachments.

22 Claims, 10 Drawing Sheets

FOREIGN PATENT DOCUMENTS

| | | |
|---|---|---|
| EP | 0 293 210 | 11/1988 |
| JP | 48-073542 | 9/1973 |
| JP | 51-117853 | 10/1976 |
| JP | 52-152145 | 12/1977 |
| JP | 53-135552 | 11/1978 |
| JP | 56-020301 | 2/1981 |
| JP | 07-307602 | 11/1995 |
| JP | 2000-082901 | 3/2000 |
| JP | 2000-332507 | 11/2000 |
| WO | 02/067361 | 8/2002 |

OTHER PUBLICATIONS

Helszajn J et al: "Polynomial Representations of Split-Phase Constants of Gyromagnetic Waveguides with Electric and Magnetic Walls ", IEEE Microwave and Guided Wave Letters, vol. 7, No. 9, Sep. 1, 1997, XP011035209 IEEE Inc, New York, US pp. 291-293.

Anonymous: "Ferrite Device Reliability: A Method For Predicting Ferrite Device Reliability Using Interference Theory" EMS Technologies, Inc., [Online] Sep. 2004, pp. 1-20, XP002537752.

L. Lin: "Theory and Design of Ferrite Latching WaveGuide Junction Circulators" Microwave Journal, vol. 30, No. 12, Dec. 1987, pp. 124-128, XP002537750.

Supplementary European Search Report dated Jul. 20, 2009.

* cited by examiner

FERRITE WAVEGUIDE CIRCULATOR WITH THERMALLY-CONDUCTIVE DIELECTRIC ATTACHMENTS

CROSS REFERENCE TO RELATED APPLICATIONS

This application claims priority under 35 U.S.C. §119(e) from U.S. Provisional Patent Application No. 60/752,339, filed on Dec. 20, 2005, which is incorporated herein by reference.

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Field of the Invention

The present invention relates to waveguide circulators, and more particularly to improved power handling capabilities for ferrite waveguide circulators through the use of thermally-conductive dielectric attachments.

2. Description of the Related Art

Ferrite circulators have a wide variety of uses in commercial and military, space and terrestrial, and low and high power applications. A waveguide circulator may be implemented in a variety of applications, including but not limited to transmit/receive (T/R) modules, isolators for high power sources, and switch matrices. One important application for such waveguide circulators is in space, especially in satellites where extreme reliability is essential and where size and weight considerations are very important. Ferrite circulators are desirable for these applications due to their high reliability, as there are no moving parts required. This is a significant advantage over mechanical switching devices.

A commonly used type of waveguide circulator has three waveguide arms arranged at 120° and meeting in a common junction. This common junction is loaded with a non-reciprocal material such as ferrite. When a magnetizing field is created in this ferrite element, a gyromagnetic effect is created that can be used for circulating the microwave signal from one waveguide arm to another. By reversing the direction of the magnetizing field, the direction of circulation between the waveguide arms is reversed. Thus, a switching circulator is functionally equivalent to a fixed-bias circulator but has a selectable direction of circulation. Radio frequency (RF) energy can be routed with low insertion loss from one waveguide arm to either of the two output arms. If one of the waveguide arms is terminated in a matched load, then the circulator acts as an isolator, with high loss in one direction of propagation and low loss in the other direction.

Generally, these three-port waveguide switching circulators are impedance matched to an air-filled waveguide interface. For the purposes of this description, the terms "air-filled," "empty," "vacuum-filled," or "unloaded" may be used interchangeably to describe a waveguide structure. Conventional three-port waveguide switching circulators typically have one or more stages of quarter-wave dielectric transformer structures for purposes of impedance matching the ferrite element to the waveguide interface. The dielectric transformers are typically used to match the lower impedance of the ferrite element to the higher impedance of the air-filled waveguide so as to produce low loss. Thin adhesive bondlines are used to attach the transformers to the ferrite element and the waveguide structure, so they also provide a thermally conductive path from the ferrite element to the waveguide structure for transferring heat out of the ferrite element.

Previous patents have described approaches for achieving broad bandwidth through the addition of impedance matching elements. Broadband circulators have high isolation and return loss and low insertion loss over a wide frequency band, which is desirable so that the circulator is not the limiting component in the frequency bandwidth of a system. Broad bandwidth also allows a single design to be reused in different applications, thereby providing a cost savings. These previous approaches for achieving broad bandwidth generally involve the addition of quarter-wave dielectric transformers or steps in the height or width of the waveguide structure to thus achieve impedance matching the ferrite element to the waveguide port. For example, previous approaches have disclosed achieving impedance matching by providing a step or transition in the waveguide pathway. This technique eliminates the standard dielectric transformers, thereby eliminating a thermal path for conducting heat out of the ferrite element. This technique also relies on the presence of a significant gap or spacing between adjacent ferrite elements, increasing the size and weight of the structure. These methods all require impedance matching elements in addition to the ferrite element in order to achieve acceptable performance. Other approaches include changing the shape of the ferrite resonant structure to achieve broadband performance. However, these ferrite structures are restricted to fixed-bias applications with a single direction of circulation.

Referring now to FIG. 1, there is shown a top view of a conventional ferrite element. Although magnetizing windings are not shown, dashed lines 135 denote the apertures for the magnetizing windings. The apertures 135 for the magnetizing windings may be created by boring a hole through each leg of the ferrite element, for example. If a magnetizing winding is inserted through the apertures, then a magnetizing field may be established in the ferrite element, as would be evident to those possessing an ordinary skill in the pertinent arts. The polarity of this field may be switched, alternately, by the application of current on the magnetizing winding to thereby create the switchable circulator.

Resonant section 130 exists where the legs of device 101 converge inside the three apertures 135. As would be evident to those possessing an ordinary skill in the pertinent arts, the dimensions of resonant section 130 determine the operating frequency for circulation in accordance with conventional design and theory. The sections 140 of the ferrite element in the area outside of the magnetizing winding apertures 135 may act as return paths for the bias fields in the resonant section 130 and as impedance transformers out of the resonant section. Faces 150 of the ferrite element are located at the outer edges of the three legs.

Referring now to FIG. 2, there is shown a top view of a conventional single-junction waveguide circulator structure. FIG. 2 shows a ferrite element 101 with a quarter-wave dielectric transformer 103 attached to each leg. As shown in FIG. 2, the quarter-wave dielectric transformers 103 are generally much narrower than the ferrite element 101, which limits the ability of the quarter-wave dielectric transformers 103 in providing a thermally conductive path from the ferrite element 101 to the waveguide structure 100. A dielectric spacer 102 may be disposed on the top and bottom surfaces of ferrite element 101. Spacer 102 may be used to properly position the ferrite element in the housing and to provide a thermal path out of ferrite element 101 to the conductive (electrically and thermally) waveguide structure 100. Conventional circulators have minimized the diameter of this spacer for impedance matching purposes, and the diameter is generally smaller than the size of resonant section 130 discussed hereinabove. Generally, a smaller diameter spacer will provide more frequency bandwidth and a poorer thermal path. This opposing effect makes high power, broadband circulators difficult to achieve.

The conventional components described above may be disposed within the conductive waveguide structure 100, which is generally air-filled. For the purposes of this description, the terms "air-filled," "empty," "vacuum-filled," or "unloaded" may be used interchangeably to describe a waveguide structure. Conductive waveguide structure 100 may include waveguide input/output ports 105. Ports 105 may provide interfaces, such as for signal input and output, for example. Empirical matching elements 104 may be disposed on the surface of conductive waveguide structure 100 to affect the performance. Matching elements 104 may be capacitive/inductive dielectric or metallic buttons that are used to empirically improve the impedance match over the desired operating frequency band.

Referring now to FIG. 3, there is shown a partial side view of a conventional single-junction waveguide circulator structure. As may be seen in FIG. 3, only one of the three legs of the ferrite element is shown. This view shows dielectric spacers 102 located between the walls of waveguide structure 100 and ferrite element 101. Adhesive materials are used to bond the dielectric spacers 102 to the waveguide structure 100 and to the ferrite element 101. As a result of the dielectric spacers 102 being much smaller in diameter than the legs of ferrite element 101, air gaps 110 exist above and below portions of the legs of the ferrite element. Air gaps 110 may be approximately one-third the height of the waveguide in the E-plane axis. Co-pending, commonly assigned patent application, U.S. non-provisional patent application Ser. No. 11/107,351 titled Latching Ferrite Waveguide Circulator Without E-Plane Air Gaps (the '351 application), incorporated herein by reference, describes implementations wherein the E-plane air gaps have been eliminated through the use of filler materials between the ferrite element 101 and the waveguide structure 100. The primary purpose of these filler materials is to suppress the high peak power breakdown effects such as arcing or multipactor. For broad bandwidth applications, these materials will generally have a low dielectric constant (less than 3), thereby preventing the use of the more thermally conductive dielectrics such as aluminum nitride, boron nitride, and beryllium oxide, which all have relative dielectric constants greater than 4.

The purpose of a ferrite circulator is to circulate RF power from one port to another while absorbing a minimal amount of the circulating power. All of the dielectric and ferrite materials in circulators absorb some power, but the majority of the power absorbed by a ferrite circulator is contained in the ferrite element due to the relatively high volume of the ferrite element 101 and the high electrical and magnetic loss tangents of the ferrite material. In conventional single-junction waveguide circulators, such as illustrated in FIG. 3, the ferrite temperature rise resulting from the power absorption is primarily dependent on the thermal resistance of the various paths from the ferrite element 101 to the thermally conductive waveguide structure 100. The waveguide structure 100 acts as a heat sink for the ferrite element 101, but the thermal paths between these two parts are limited in conventional circulators. These paths flow from the ferrite element 101 through adhesive bonds to either the dielectric spacers 102 or quarter-wave dielectric transformers 103 and on through adhesive bonds to the waveguide structure 100. The dimensions of the dielectric spacers 102 and quarter-wave dielectric transformers 103 are restricted by RF performance requirements rather than thermal requirements.

Accordingly, a need exits for a ferrite circulator that incorporates thermally conductive dielectric attachments in order to maximize the area of contact with the ferrite for improved heat transfer beyond the present art, thereby allowing ferrite circulators to operate at higher average microwave power levels.

SUMMARY

The present invention improves upon the geometry of conventional ferrite circulators in order to increase the average power handling and decrease the temperature rise in the ferrite and associated adhesive bondlines. Embodiments of the present invention utilize thermally conductive dielectric attachments on the sides of the ferrite element. These attachments significantly improve the thermal conductivity of the path from the ferrite element to the waveguide structure. If the attachments are good thermal conductors—such as, for example, boron nitride, aluminum nitride, or beryllium oxide—they can be relatively thin (for example, less than about 0.02" thick for operations at about 20 GHz) to minimize the dielectric loading impact on RF performance while still improving the thermal performance of the circulator. Embodiments of the present invention decrease the maximum temperature of the ferrite element and associated bondlines, thus improving the performance and survivability of ferrite circulators in high power applications. Because of the increasing power handling capabilities in embodiments of the present invention, the ferrite circulators are suitable for a broader range of applications, making them a viable alternative to other switch technologies in high average power applications.

In one aspect of the invention, a ferrite waveguide circulator is provided. The circulator includes a waveguide structure having an internal cavity, the waveguide structure including a plurality of ports extending from the internal cavity. The circulator also includes at least one ferrite element disposed in the internal cavity, said ferrite element including at least one leg having at least two side surfaces and one face surface. At least one thermally-conductive dielectric attachment is affixed to at least one of the side surfaces of the ferrite element.

In another aspect of the invention, a ferrite waveguide circulator is provided having a waveguide structure having an internal cavity, the waveguide structure including a plurality of ports extending from the internal cavity. The circulator also includes at least one ferrite element disposed in the internal cavity, said ferrite element including at least one leg having at least two side surfaces and one face surface. At least one thermally-conductive dielectric attachment is affixed to at least one of said face surfaces of the ferrite element.

In a further aspect of the invention, a system for circulating microwaves in a waveguide is provided. The system includes a waveguide structure having an internal cavity forming an input port and one or more output ports; a ferrite element that substantially exclusively couples microwaves from said input port to one of said output ports, wherein the substantially exclusive coupling is responsive to an activation of at least one magnetizable winding associated with said ferrite element; and at least one thermally conductive dielectric attachment affixed to the ferrite element so as to conduct thermal energy away from said ferrite element.

Additional advantages of the invention will be set forth in the description which follows, and in part will be obvious from the description, or may be learned by practice of the invention. The advantages of the invention may be realized and obtained by the instrumentalities and combinations particularly pointed out hereinafter.

BRIEF DESCRIPTION OF THE DRAWINGS

The accompanying drawings are included to provide further understanding of the invention and are incorporated in and constitute a part of this specification. The accompanying drawings illustrate embodiments of the invention and together with the description serve to explain the principles of the invention. In the figures.

DETAILED DESCRIPTION OF THE INVENTION

Figure 1:
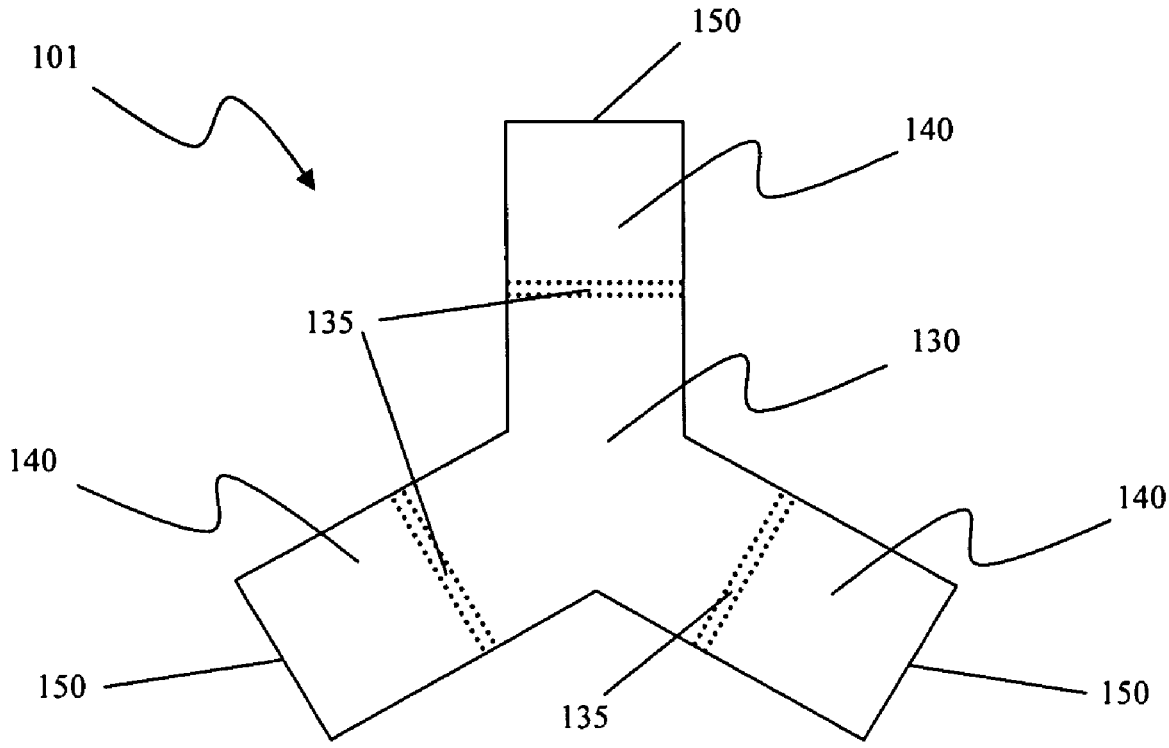
FIG. 1 (prior art)
FIG. 1 shows a top view of a conventional ferrite element.
Figure 2:
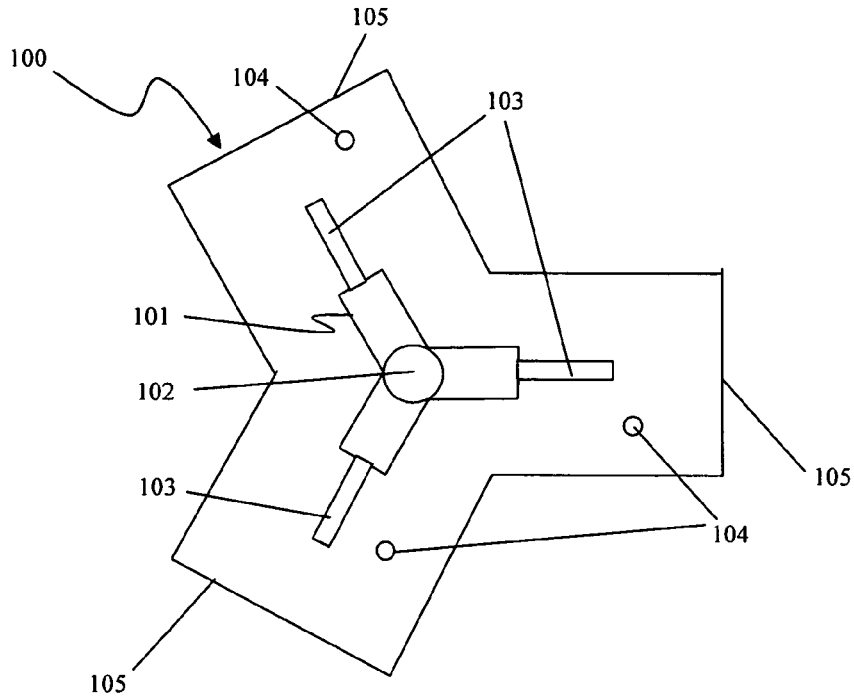
FIG. 2 (prior art)
FIG. 2 shows a top view of a conventional single-junction waveguide circulator structure.
Figure 3:
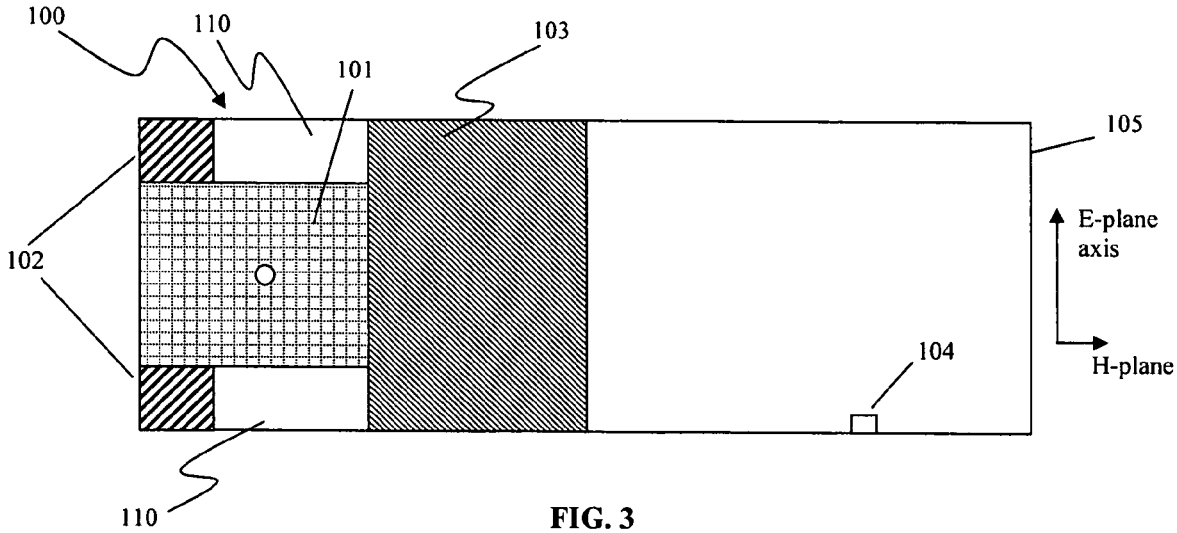
FIG. 3 (prior art)
FIG. 3 shows a partial side view of a conventional single-junction waveguide circulator structure.

Reference will now be made in detail to the preferred embodiments of the invention, examples of which are illustrated in the accompanying drawings.

The embodiments of the present invention increase the average power handling over conventional ferrite circulators by decreasing the temperature rise in the ferrite and associated adhesive bonds. Due to the electrical and magnetic losses inherent in ferrite materials, the ferrite elements in circulators absorb a portion (generally around 2%) of the microwave power that passes through the devices. As ferrite is a relatively poor thermal conductor, the absorbed power results in high internal temperatures in the ferrite and the adhesives used to attach the ferrite to the traditional quarter-wave dielectric transformers and dielectric spacers. The high temperatures in the ferrite result in a degradation in performance, as the material properties of the ferrite change with temperature. The high temperatures in the adhesives can cause failures in the bondline resulting in outgassing or weakening of the bond.

Thermal conductance is inversely proportional to length and proportional to area. Thus, the thermal conductance of the path from the ferrite element to the heat sinking waveguide structure can be improved by maximizing the surface area contact and minimizing the length of travel of the absorbed power out from the ferrite element to the attached dielectrics. Both of these requirements are met through the use of thermally-conductive dielectric attachments as utilized in this new invention. The basic thermal design problem for circulators is to get the absorbed heat out of the ferrite element though dielectric attachments to the waveguide structure, which is an excellent thermal conductor. The traditional dielectric attachments are the dielectric spacers and quarter-wave dielectric transformers. For impedance matching purposes, the area of the dielectric spacer is generally minimized and kept within the resonant section of the ferrite element. Thus, its area of contact with the ferrite element is limited to a small Y-shaped cross-section in the center of the part. The traditional quarter-wave dielectric transformers are a quarter-wavelength long with a width on the order of ⅓ that of the ferrite element, again resulting in a small area of contact. Since the height and length of the ferrite element are usually 1.5 to 2 times longer than the width of the ferrite element, the traditional dielectric attachments have the thermally undesirable combination of a small area of contact at a long distance from the heat source.

Generally, embodiments of the present invention utilize thermally-conductive dielectric attachments on the sides of the ferrite element, which maximize the area of contact and minimize the path length from the ferrite element out to the thermally-conductive dielectric attachments. Because these thermally-conductive dielectric attachments are good thermal conductors, such as boron nitride, aluminum nitride, or beryllium oxide, they can be relatively thin (less than about 0.02" thick for operations at about 20 GHz) to minimize the dielectric loading effects without impacting the thermal performance. Generally, the thermally-conductive dielectric attachments may be made from any otherwise suitable material having a thermal conductivity of at least 0.01 W/(in.$^{2}$·° C.). So, a primary advantage of the new invention is to decrease the maximum temperature of the ferrite element and associated adhesive bondlines in order to improve the performance and survivability of ferrite circulators in high power applications. For example, a switch of the present invention, operating near 20 GHz, was found to handle 1.8 times as much power as a traditional switch for the same temperature rise in the ferrite element. Looking at this another way, the temperature rise in the ferrite for the present invention was only 56% of the temperature rise in the traditional switch for equal power levels. There are many RF switching applications where alternate switch technologies, such as pin diode or mechanical switches, are used because of their power handling capabilities. This invention broadens the applications for ferrite switches, making them a viable alternative to other switch technologies in high average power applications.

Figure 4:
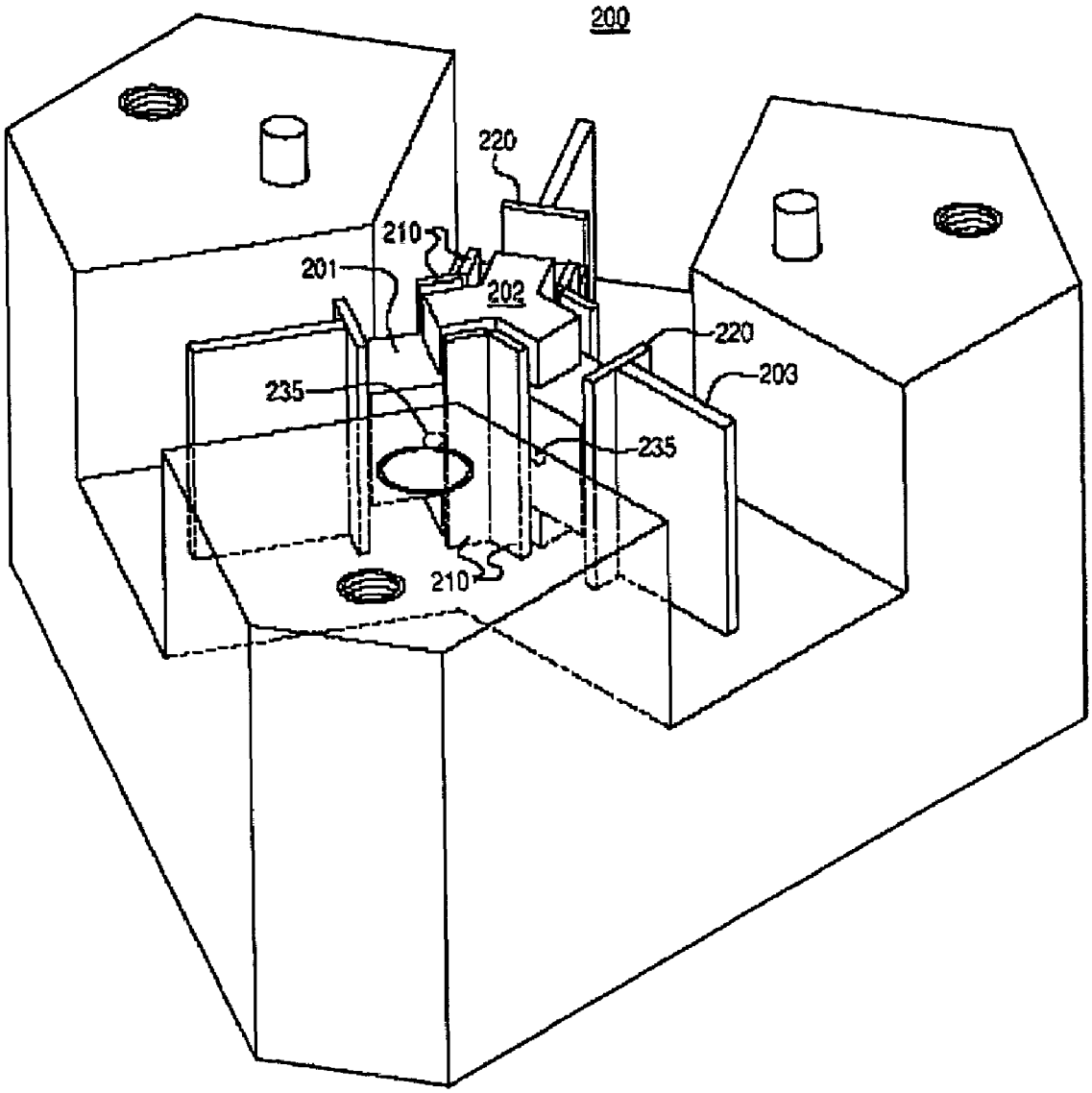
FIG. 4 shows a perspective view of the internal portion of a waveguide circulator structure incorporating thermally-conductive, rectangular dielectric attachments on the sides of the resonant section and faces of the ferrite element according to one embodiment of the present invention.

Referring to FIG. 4, the figure provides a perspective view of the internal portion of a waveguide circulator structure 200 that incorporates thermally-conductive, rectangular dielectric attachments 210, 220 on the sides of the resonant section and faces of the ferrite element 201 according to one embodiment of the present invention. A dielectric spacer 202 is shown disposed upon a top surface of a non-reciprocal ferrite element 201. A quarter-wave dielectric transformer 203 is attached to each of the face attachments 220 for impedance matching purposes. Apertures 235 are provided for magnetizing windings (not shown). The apertures 235 for the magnetizing windings may be created, for example, by boring a hole through each leg of the ferrite element 201. FIG. 4 is provided primarily for perspective, while the details of the structure are discussed further with respect to the subsequent figures.

Figure 5:
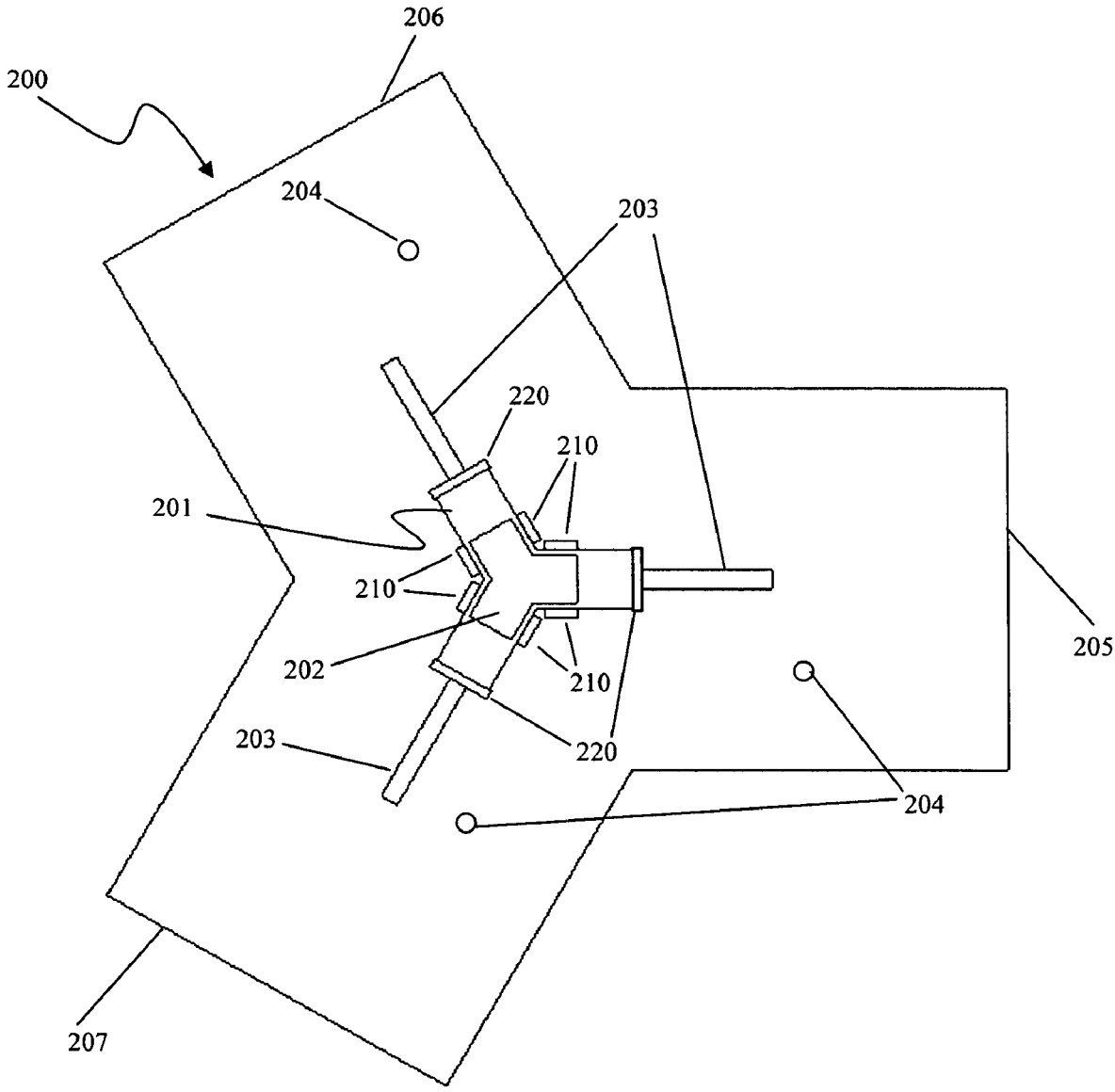
FIG. 5 shows a top view of a waveguide circulator structure having thermally-conductive, rectangular dielectric attachments on the sides of the resonant section and faces of the ferrite element according to one embodiment of the present invention.

Referring now to FIG. 5, there is shown a top view of the device of FIG. 4 according to an embodiment of the present invention. The dielectric spacers 202 may be disposed on the top and bottom surfaces of the non-reciprocal ferrite element 201. Although dielectric spacers 202 are shown in the figures as having a "Y" shape, any geometry may be used for the dielectric spacers 202, provided that they do not interfere with the thermally-conductive dielectric side attachments 210. In an exemplary embodiment, the side attachments 210 are rectangular in shape and attach to the resonant section of the ferrite element 201. Thermally-conductive dielectric face attachments 220 are attached to the faces of the ferrite element 201. In the embodiment of FIG. 5, these face attachments 220 cover at least 50% of the surface area of the face of the ferrite element 201 in order to provide a desirable thermal benefit over the traditional dielectric transformers. However, face attachments 220 may provide some thermal benefit provided the surface area of face attachment 220 covering the face of the ferrite element 201 exceeds that of the quarter-wave dielectric transformers 203. In this embodiment, the traditional quarter-wave dielectric transformers 203 are attached to the face attachments 220 as separate pieces. These two parts could be combined into a single face attachment/quarter-wave dielectric transformer assembly as well, as they can both be manufactured out of thermally-conductive dielectric materials. The thermally-conductive dielectric materials include but are not limited to boron nitride, aluminum nitride, and beryllium oxide. Empirical matching elements 204 may be disposed in close proximity to quarter-wave dielectric transformers 203. All of the components described above may be disposed completely, partially or substantially within conductive waveguide structure 200.

The conductive waveguide structure may be air-filled. Conductive waveguide structure 200 may also include waveguide input/output ports 205, 206, and 207. Waveguide ports 205, 206, and 207 may provide interfaces for signal input and output. The empirical matching elements 204 may be disposed on the surface of conductive waveguide structure 200 to affect the performance characteristics. Matching elements may be capacitive/inductive dielectric or metallic buttons used to empirically improve the impedance match over the desired operating frequency band.

Still referring to FIG. 5, in operation of waveguide structure 200 as a one input/two output switch, an RF signal may be provided as input to waveguide port 205 and delivered as output through either waveguide port 206 or 207. The signal enters the waveguide structure 200 through the waveguide port 205 and, depending upon the magnetization of ferrite element 201, is directed toward waveguide port 206 or 207. The direction of signal propagation through a ferrite element can be described as clockwise or counter-clockwise with respect to the center of the ferrite element. For example, if the signal input through waveguide port 205 passes in a clockwise direction through ferrite element 201, then it will propagate toward waveguide port 207. The RF signal will thereby exit through waveguide port 207 with low insertion loss. To change the low loss output port from the first output 207 to the second output 206, a magnetizing current is passed through a magnetizing winding (not shown) so as to cause circulation through ferrite element 201 in the counterclockwise direction. This allows the RF signal to propagate from the input port 201 to the second output port 206 with low insertion loss.

As the RF signal propagates through the waveguide structure 200, some power is absorbed in the various switch elements, and the majority of this absorbed power is contained in the ferrite element 201 due to its relatively high volume and high electrical and magnetic loss tangents. The waveguide structure 200 acts as a heat sink for the ferrite element 201. In conventional circulators, the thermal paths between these two parts are limited by the intersecting area between the ferrite element and the dielectric spacers and quarter-wave dielectric transformers. In the embodiment illustrated in FIG. 4 and FIG. 5, the addition of thermally-conductive dielectric attachments 210 and 220 more than doubles the area of dielectric contact to the ferrite element 201. This increase in surface contact area increases the thermal conductance of the path from the ferrite element 201 to the waveguide structure 200, resulting in approximately half the temperature rise in the ferrite element 201 or the ability to handle approximately twice the RF power with an equivalent temperature rise as compared to traditional circulators.

Figure 6:
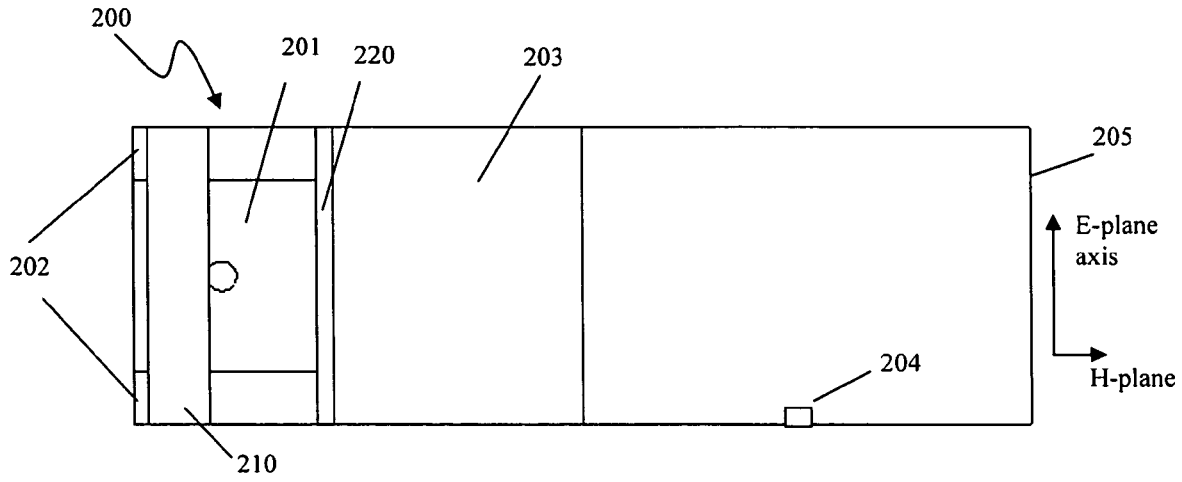
FIG. 6 shows a partial side view of the structure shown in FIG. 5.

Referring now also to FIG. 6, there is shown a side view of the circulator of FIG. 5. In this view, only one of the three legs of the ferrite element is shown. Portions of dielectric spacers 202 are shown above and below the ferrite element 201. The quarter-wave dielectric transformer 203 is shown extending toward the waveguide port 205 at an edge of the conductive waveguide structure 200. Empirical matching element 204 is also shown. As shown in FIG. 6, side attachments 210 and face attachments 220 are deployed to cover a large area of the ferrite element 201 and to contact the conductive waveguide structure 200. Different shapes of side and face attachments may be used to provide a similar substantial thermal benefit. Side attachments 210 need not cover a substantial area of the side surface of the ferrite element 201 to provide some thermal benefit. Side attachments 210 covering as little as 5% of the side surface of the ferrite element 201 may provide thermal benefits.

Figure 7:
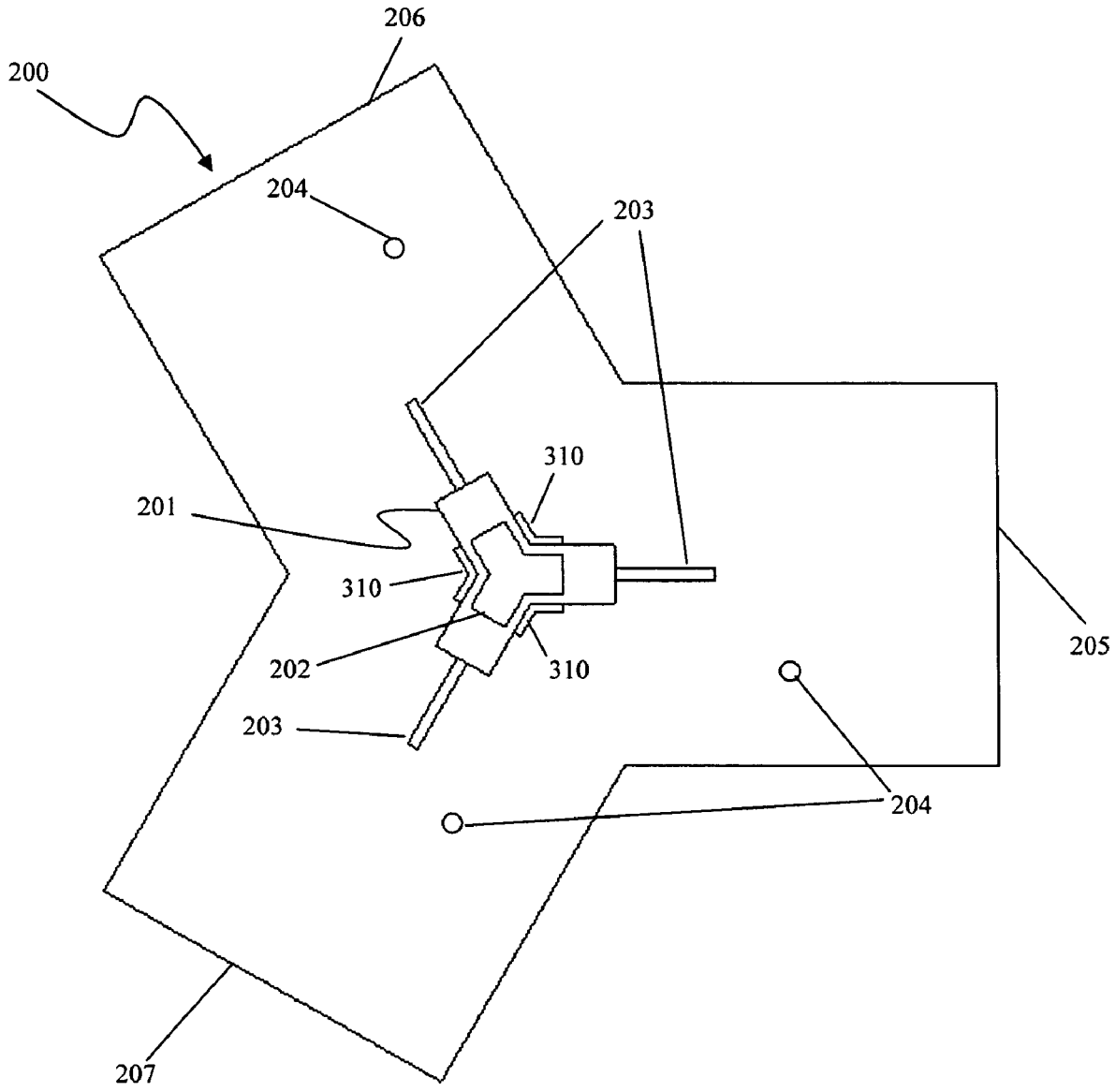
FIG. 7 shows a top view of a waveguide circulator structure incorporating thermally-conductive, V-shaped dielectric attachments on the sides of the resonant section of the ferrite element according to an aspect of the present invention.

Referring now to FIG. 7, there is shown a top view of another embodiment of the device according to the present invention. As may be seen in FIG. 7, thermally-conductive dielectric side attachments 310 may be disposed on the side surfaces of ferrite element 201. While the previous embodiment utilized six rectangular side attachments 210, the embodiment of FIG. 7 shows three V-shaped side attachments 310 that conform to the shape of the ferrite element. Furthermore, this embodiment does not make use of the face attachments 220 of the previous embodiment. This illustrates that the side attachments 310 and face attachments 220 can be used independent of one another. Either attachment will reduce the maximum temperature of the ferrite element 201, so the location of the attachments is a balance of the thermal circuit and the impedance matching of the ferrite element 201 to the waveguide ports 205, 206, 207. As described hereinabove, dielectric spacers 202, quarter-wave dielectric transformers 203, empirical matching elements 204, and conductive waveguide structure 200, may also be used in this aspect of the present invention as well.

Figure 8:
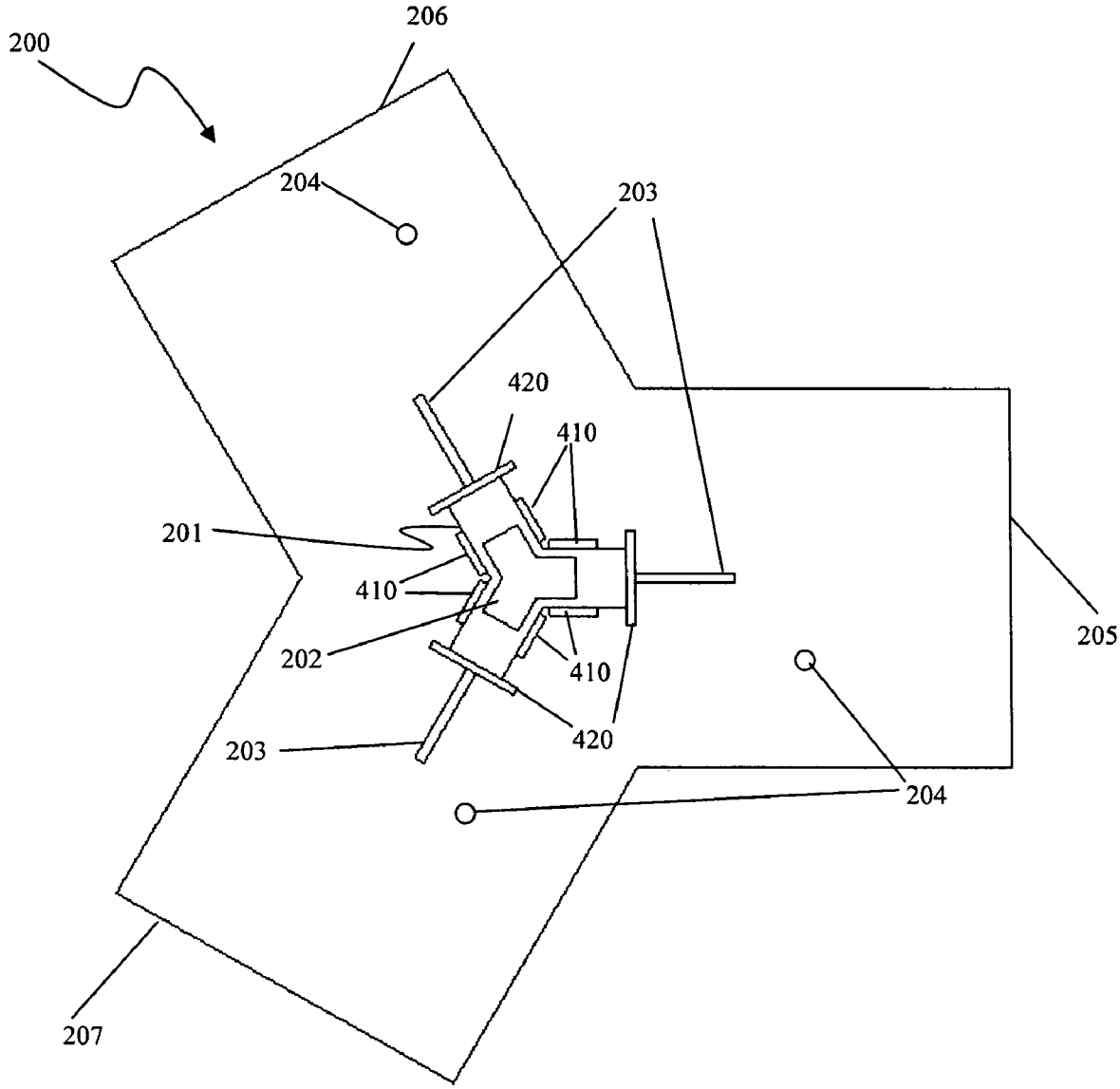
FIG. 8 shows a top view of a waveguide circulator structure incorporating thermally-conductive, dielectric attachments, tapered in profile, on the sides of the resonant section of the ferrite element according to an aspect of the present invention.

Referring now to FIG. 8, there is shown a top view of an embodiment of a device according to an aspect of the present invention. As may be seen in FIG. 8, thermally-conductive dielectric side attachments 410 and face attachments 420 may be disposed on the side surfaces of ferrite element 201. While a previous embodiment utilized six rectangular side attachments 210 and three rectangular face attachments 220, the embodiment of FIG. 8 utilizes six tapered side attachments 410 and six tapered face attachments 420. The same part is used for all twelve attachments to reduce the number of different parts used in this illustration.

Figure 9:
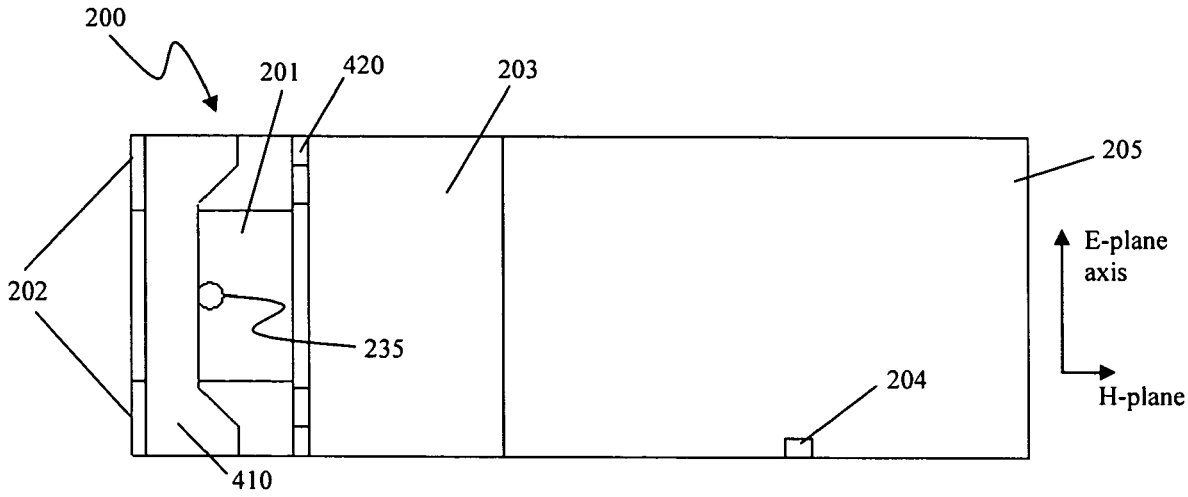
FIG. 9 shows a partial side view of the structure shown in FIG. 8.

Referring now also to FIG. 9, there is shown a side view of the circulator of FIG. 8. In this view, only one of the three legs of the ferrite element is shown. This view illustrates the tapered (or flared) shape of the side attachments 410 and face attachments 420. The side attachment 410, for example, is shown with a narrower middle portion with wider top and bottom portions so as to not cover aperture 235 for the magnetizing windings (not shown). A tapered shape can provide a compromise between dielectric loading and thermal resistance, as it allows for an increased area of contact between the side attachments 410 and face attachments 420 to the waveguide structure 200. As will be understood by one skilled in the art, other non-rectangular or non-uniform shapes may be used for the dielectric attachments to optimize dielectric loading and thermal resistance.

Figure 10:
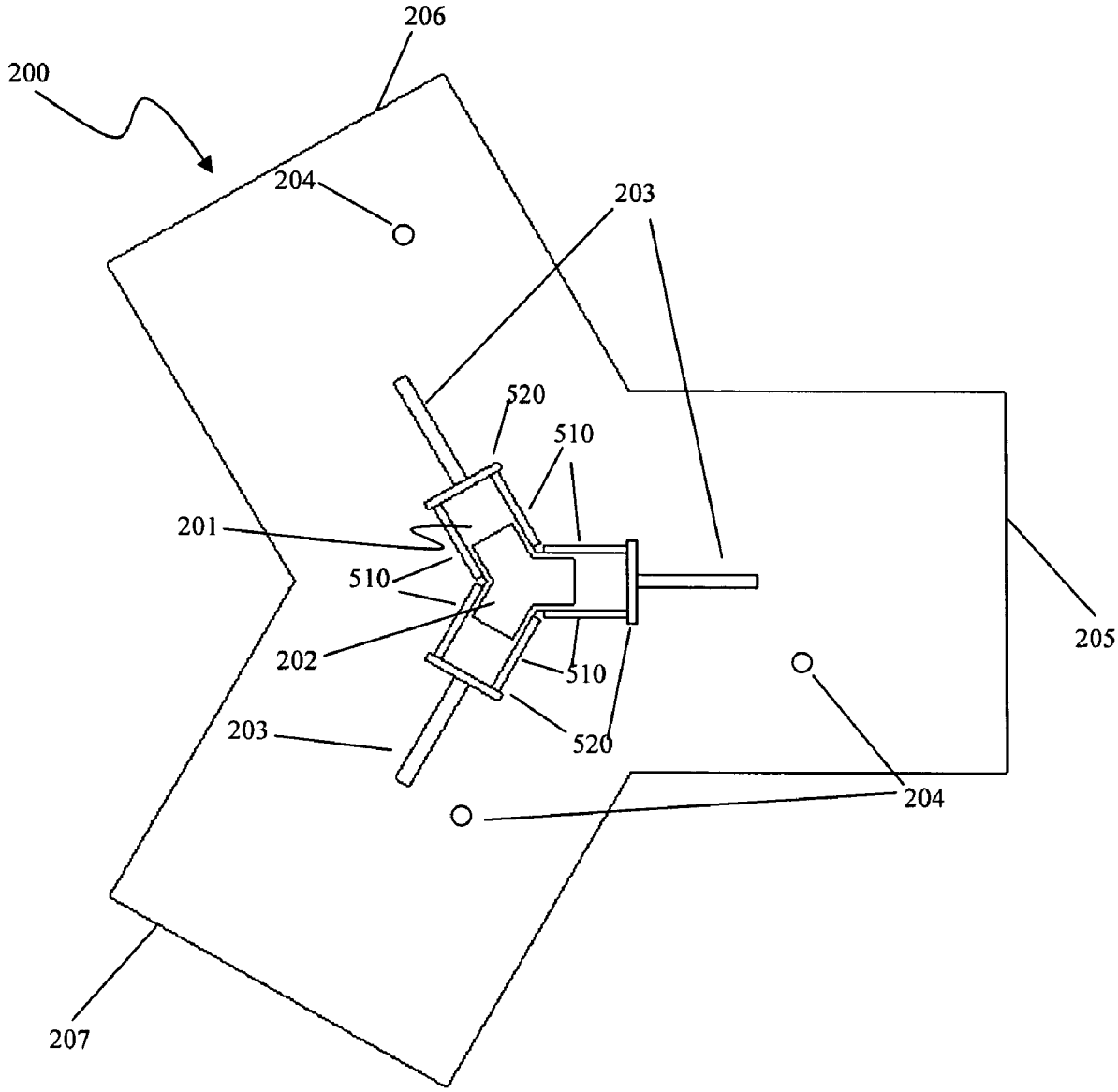
FIG. 10 shows a top view of a waveguide circulator structure incorporating thermally-conductive, rectangular dielectric attachments on the sides and faces of the ferrite element according to an aspect of the present invention.

Referring now to FIG. 10, there is shown a top view of an embodiment of a device according to an aspect of the present invention. As may be seen in FIG. 10, thermally-conductive dielectric side attachments 510 and face attachments 520 may be disposed on the side surfaces of ferrite element 201. While previous embodiments disclosed herein in FIGS. 4-9 utilized side attachments 210, 310, 410 that were constrained in size to the resonant section of the ferrite element 201, the embodiment of FIG. 10 utilizes side attachments 510 that cover nearly the complete length of the sides of the ferrite element 201. Combined with the face attachments 520, a perimeter of thermally-conductive dielectric attachments is formed around the ferrite element 201 in order to maximize the area of contact between the ferrite element 201 and the attachments 510 and 520. Comparison of the side attachments 310 of FIG. 7 and the side attachments 510 of FIG. 10 shows that the entire perimeter of the ferrite element 201 could be covered within the bounds of this invention, but the arrangement of FIG. 10 will likely result in a more manufacturable design given machining tolerances on the parts involved.

Figure 11:
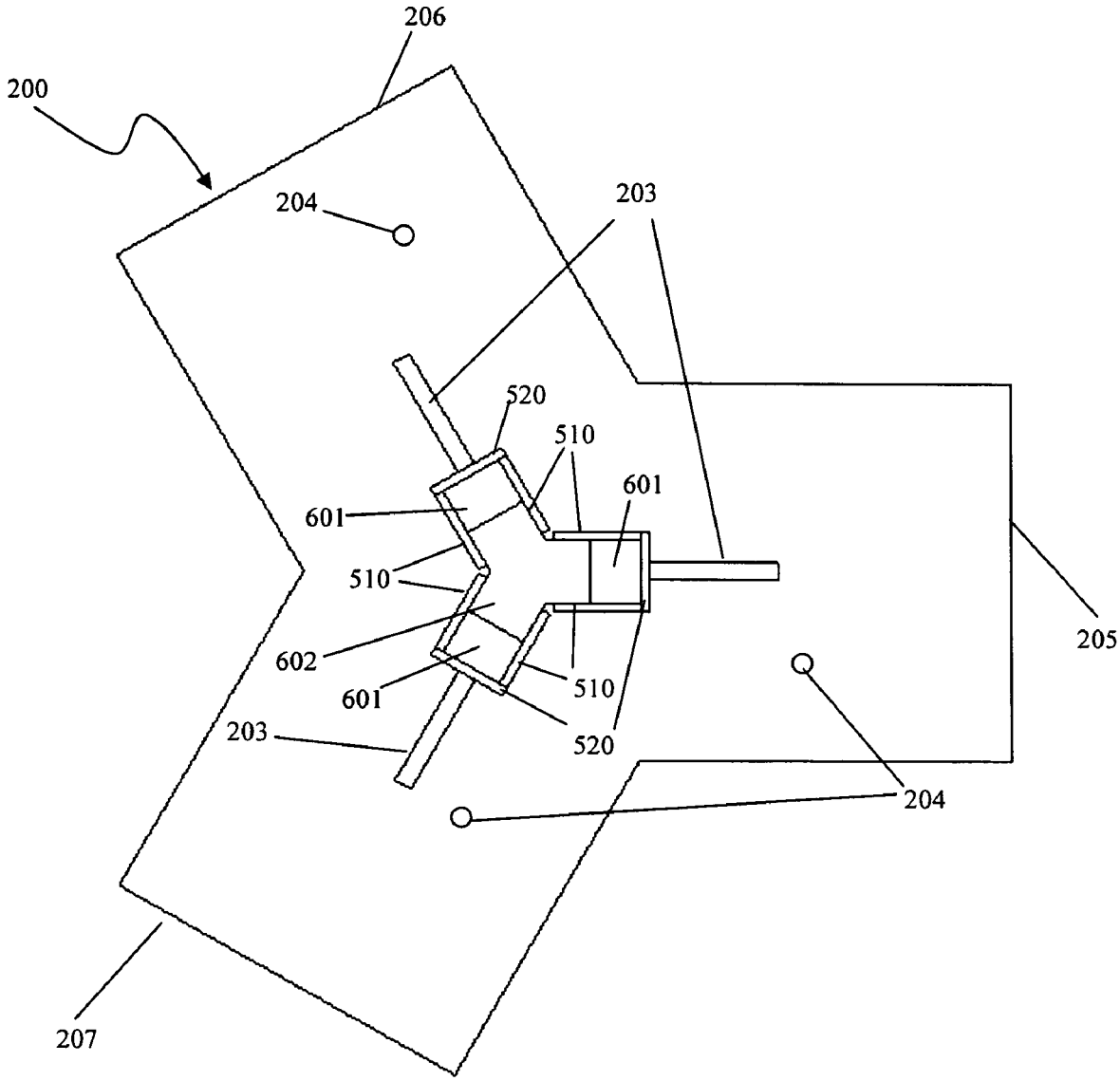
FIG. 11 shows a top view of a waveguide circulator structure incorporating thermally-conductive, rectangular dielectric attachments on the sides and faces of the ferrite element and incorporating multiple dielectric spacers to fill the gaps above and below the ferrite element according to an aspect of the present invention.

Referring now to FIG. 11, there is shown a top view of an embodiment of a device according to an aspect of the present invention. As may be seen in FIG. 11, thermally-conductive dielectric side attachments 510 and face attachments 520 may be disposed on the side surfaces of a ferrite element (the ferrite element is not visible in this view, but corresponds to element 201 in previous figures) in a configuration similar to that shown in FIG. 10. While this previous embodiment utilized a dielectric spacer 202 that partially covered the surface of ferrite element 201, the present invention utilizes filler materials 601 and 602 that completely fill the air gaps between the ferrite element 201 and the waveguide structure 200. Elimination of these air gaps may be critical to eliminate high power breakdown phenomena such as arcing or multipactor due to the orientation of the electric field and the high voltages in the area between the ferrite element 201 and the waveguide structure 200. The materials selected for filler materials 601 and 602 may be chosen independently in terms of microwave and thermal properties to allow for more flexibility in the impedance matching of the circulator. The combination of the top filler materials 601 and 602 may provide an area that completely covers ferrite element 201, thereby eliminating air gaps between ferrite element 201 and conductive waveguide structure 200, such as in the critical axis running into/out of the page, for example. Although filler materials 601 and 602 are shown in the figures as having a similar "Y" shape to the ferrite element 201, any geometry may be used for the filler materials 601 and 602 provided that the area shown in the top view completely covers the area of the ferrite element 201 and allows for attachment of the thermally-conductive dielectric side attachments 510 and face attachments 520 over a substantial area of the ferrite element 201. As described hereinabove, quarter-wave dielectric transformers 203, empirical matching elements 204, and conductive waveguide structure 200, may also be used in this aspect of the present invention as well While exemplary embodiments of the invention have been shown and described herein, it will be obvious to those skilled in the art that such embodiments are provided by way of example only. Numerous insubstantial variations, changes, and substitutions will now be apparent to those skilled in the art without departing from the scope of the invention disclosed herein by the Applicant. Accordingly, it is intended that the invention be limited only by the spirit and scope of the claims, as they will be allowed.

I claim:

1. A ferrite waveguide circulator, comprising:

a waveguide structure having an internal cavity, the waveguide structure including a plurality of ports extending from the internal cavity;

at least one ferrite element disposed in the internal cavity, said ferrite element including at least one leg having a length dimension, a height dimension, and a width dimension, wherein the length dimension is parallel to the direction of propagation of a signal through the leg of the ferrite element, the height dimension and the width dimension are perpendicular to the direction of propagation of a signal through the leg of the ferrite element, and the height dimension is larger than the width dimension, said at least one leg of the ferrite element having at least two side surfaces and one face surface, wherein said side surfaces extend along the length dimension and the height dimension and the face surface extends along the height dimension and the width dimension; and at least one thermally-conductive dielectric attachment affixed to at least one of said side surfaces of the ferrite element.

2. The ferrite waveguide circulator according to claim 1, wherein the dielectric attachment is one of boron nitride, aluminum nitride, beryllium oxide, and combinations thereof.

3. The ferrite waveguide circulator according to claim 1, wherein the dielectric attachment has a thermal conductivity of at least 0.01 W/(in.$^2$·°C.).

4. The ferrite waveguide circulator according to claim 1, wherein the dielectric attachment is less than or equal to about 0.02" thick for operating ranges about 20 GHz.

5. The ferrite waveguide circulator according to claim 1, wherein the dielectric attachment is affixed to one of said side surfaces and covers at least 5% of the surface area of that side surface.

6. The ferrite waveguide circulator according to claim 1, wherein the ferrite element includes at least two legs, wherein one dielectric attachment is jointly affixed to a side of each of two legs.

7. The ferrite waveguide circulator according to claim 1, further comprising at least one dielectric spacer disposed on an outer surface of the at least one ferrite element.

8. The ferrite waveguide circulator according to claim 1, further comprising at least one empirical matching element disposed within the internal cavity.

9. The ferrite waveguide circulator according to claim 1, wherein a plurality of thermally-conductive dielectric attachments form a perimeter around the ferrite element.

10. The ferrite waveguide circulator according to claim 1, further comprising a least one filler, wherein the filler substantially fills a span between the ferrite element and a proximate opposing wall of the waveguide structure.

11. The ferrite waveguide circulator according to claim 1, further comprising at least one thermally-conductive dielectric attachment affixed to at least one of said face surfaces of the ferrite element.

12. The ferrite waveguide circulator according to claim 11, further comprising a dielectric transformer, wherein said at least one thermally-conductive dielectric attachment affixed to at least one of said face surfaces is located between said face surface and said dielectric transformer.

13. The ferrite waveguide circulator according to claim 12, wherein the at least one thermally-conductive dielectric attachment affixed to at least one of said face surfaces has a first surface area covering the face surface of the ferrite element that exceeds a second surface area of the dielectric transformer that is adjacent to the first surface area.

14. The ferrite waveguide circulator according to claim 12, wherein said dielectric attachment covers at least 50% of the surface area of the face surface.

15. A ferrite waveguide circulator, comprising:

a waveguide structure having an internal cavity, the waveguide structure including a plurality of ports extending from the internal cavity;

at least one ferrite element disposed in the internal cavity, said ferrite element including at least one leg having a length dimension, a height dimension, and a width dimension, wherein the length dimension is parallel to the direction of propagation of a signal through the leg of the ferrite element, the height dimension and the width dimension are perpendicular to the direction of propagation of a signal through the leg of the ferrite element, and the height dimension is larger than the width dimension, said at least one leg of the ferrite element having at least two side surfaces and one face surface, wherein said side surfaces extend along the length dimension and the height dimension and the face surface extends along the height dimension and the width dimension;

at least one thermally-conductive dielectric attachment affixed to at least one of said face surfaces of the ferrite element; and a quarter-wave dielectric transformer extending from said face surface, wherein the at least one thermally-conductive dielectric attachment has a surface area covering the face surface of the ferrite element that exceeds the surface area of the quarter-wave dielectric transformer.

16. The ferrite waveguide circulator according to claim 15, further comprising a filler material to eliminate air gaps between the at least one of the surfaces of the ferrite element and the waveguide structure.

17. The ferrite waveguide circulator according to claim 15, wherein the dielectric attachment is one of boron nitride, aluminum nitride, beryllium oxide, and combinations thereof.

18. The ferrite waveguide circulator according to claim 15, wherein the dielectric attachment has a thermal conductivity of at least 0.01 W/(in.$^2$·°C.).

19. The ferrite waveguide circulator according to claim 15, wherein the dielectric attachment is less that or equal to about 0.02" thick for operating ranges about 20 GHz.

20. The ferrite waveguide circulator according to claim 15, wherein said dielectric attachment covers at least 50% of the surface area of the face surface.

21. A system for circulating microwaves in a waveguide, comprising:

a waveguide structure having an internal cavity forming an input port and one or more output ports;

a ferrite element that substantially exclusively couples microwaves from said input port to one of said output ports, wherein the substantially exclusive coupling is responsive to an activation of at least one magnetizable winding associated with said ferrite element, and wherein said ferrite element includes at least one leg having a length dimension, a height dimension, and a width dimension, wherein the length dimension is parallel to the direction of propagation of a signal through the leg of the ferrite element, the height dimension and the width dimension are perpendicular to the direction of propagation of a signal through the leg of the ferrite element, and the height dimension is larger than the width dimension, said at least one leg of the ferrite element having at least two side surfaces and one face surface, wherein said side surfaces extend along the length dimension and the height dimension and the face surface extends along the height dimension and the width dimension; and at least one thermally conductive dielectric attachment affixed to at least one of said side surfaces of the ferrite element so as to conduct thermal energy away from said ferrite element.

22. The system according to claim 21, wherein the dielectric attachment has a thermal conductivity of at least 0.01 W/(in.$^2$·°C.).

* * * * *